US007254351B2

(12) United States Patent
Cao et al.

(10) Patent No.: US 7,254,351 B2
(45) Date of Patent: Aug. 7, 2007

(54) METHOD AND APPARATUS FOR REDUCING SHEET MATERIAL CURL INDUCED IN A FUSING OPERATION

(75) Inventors: Jichang Cao, Lexington, KY (US); James D. Gilmore, Lexington, KY (US); Peter B. Pickett, Lexington, KY (US); Pramod K. Sharma, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 142 days.

(21) Appl. No.: 11/143,402

(22) Filed: Jun. 2, 2005

(65) Prior Publication Data

US 2006/0275046 A1 Dec. 7, 2006

(51) Int. Cl.
*G03G 15/20* (2006.01)

(52) U.S. Cl. ..... 399/68; 219/216; 399/44; 399/69; 399/341; 430/124

(58) Field of Classification Search ..... 399/67, 399/68, 69, 44, 97, 320, 341, 400, 406; 219/216; 347/156; 430/124
See application file for complete search history.

(56) References Cited

U.S. PATENT DOCUMENTS 5,697,015 A 12/1997 Ream et al.
6,681,094 B2 1/2004 Horrall et al.
6,823,150 B1 11/2004 Cao et al.
6,947,679 B2 * 9/2005 Kato et al. ..... 399/69 X
2005/0095022 A1 * 5/2005 Fujisawa ..... 399/44
2005/0265741 A1 * 12/2005 Otsuka ..... 399/69

FOREIGN PATENT DOCUMENTS

JP 2002-169416 A * 6/2002

* cited by examiner

*Primary Examiner*—Sophia S. Chen
(74) *Attorney, Agent, or Firm*—Stevens & Showalter, LLP

(57) ABSTRACT

A fuser assembly within an image forming apparatus having a paper path along which substrates travel through the image forming apparatus including a heating member and a backup member cooperating with the heating member to form a nip therebetween for fusing images onto substrates passing through the nip. Also provided is structure for conveying substrates along the paper path to the nip, and a processor. The processor determines a relative humidity, determines if the relative humidity is above a predefined value corresponding to undesirable substrate curl; sets an interpage gap between conveyed substrates to a nominal value if the relative humidity is below the predefined value; and determines if the interpage gap should be increased beyond the nominal value if the relative humidity is above the predefined value. A corresponding method is provided.

11 Claims, 6 Drawing Sheets

METHOD AND APPARATUS FOR REDUCING SHEET MATERIAL CURL INDUCED IN A FUSING OPERATION

BACKGROUND OF THE INVENTION

1. Field of the Invention

The present invention relates to a method and apparatus for reducing sheet material curl induced in a fusing operation.

2. Description of Related Art

In an electrophotographic (EP) image forming apparatus, such as a printer or copier, a latent image is formed on a light sensitive drum and developed with an appropriate color toner. For some color printers, the toner image may then be transferred onto an intermediate transfer member (ITM) belt. For both mono and color printers, the toner image is transferred to a substrate, such as a sheet of paper. The substrate with the toner image is subsequently passed through a fuser where heat is applied to melt the toner and fuse it to the substrate. The fuser includes a hot roller cooperating with a backup roller to form a nip through which the toned substrate passes. The hot roller is provided with an internal heater, such as a tungsten-filament lamp, for generating heat, which is transferred to an outer surface of the hot roller. A temperature sensor is provided for sensing the temperature of the hot roller outer surface. The sensor generates a temperature signal to a print engine or processor for controlling the temperature of the hot roller outer surface to a predetermined target temperature.

Additionally, in order to facilitate fuser warm-up and temperature control, it is known to provide the backup roller with an internal heater for generating heat, which is transferred to an outer surface of the backup roller. An additional temperature sensor is provided for sensing the temperature of the backup roller outer surface.

In order to minimize the cost of the fuser assembly, it would be desirable to provide a heater element and temperature sensor for only the hot roller. However, when only the hot roller includes a heater element, undesirable amounts of negative longitudinal curl around a longitudinal axis of the substrate, such as a sheet of paper, may occur due to a temperature differential between the hot roller and the backup roller, i.e., the substrate curls about its longitudinal axis away from the fused toner image such that the toner image is on the outer surface of the curled substrate. For some printers, such as some mono printers, the hot roller may press into the backup roller causing a large amount of positive width curl which helps minimize fuser induced negative longitudinal curl. However, other printers, such as some color printers, generally need an aggressive reverse nip in which the backup roller presses into the hot roller to provide desirable release characteristics, resulting in negative width curl. Therefore, these other printers can not use the same technique to minimize the induced negative longitudinal curl.

Accordingly, there is a need for other techniques to reduce sheet material curl induced by a fuser assembly.

SUMMARY OF THE INVENTION

In accordance with a first aspect of the present invention, a method is provided for fusing toner images onto substrates conveyed through a fuser assembly having a heating member and a backup member cooperating with the heating member. The method may comprise the steps of: determining a relative humidity; determining if the relative humidity is above a predefined value corresponding to undesirable substrate curl; conveying substrates through the fuser apparatus at a nominal interpage gap if the relative humidity is below the predefined value; and determining if the interpage gap should be increased beyond the nominal value if the relative humidity is above the predefined value.

The step of determining a relative humidity may comprise the steps of: determining a voltage applied to a transfer roller at a toner image transfer station; and estimating the relative humidity using a predetermined relationship between the voltage applied to the transfer roller and relative humidity.

The step of determining if the interpage gap should be increased beyond the nominal value may comprise the steps of: determining a minimum backup member temperature corresponding to an acceptable level of substrate curl; and increasing the interpage gap if a current backup member temperature is less than the minimum backup member temperature.

The step of determining a minimum backup member temperature corresponding to an acceptable level of substrate curl may comprise the steps of: determining from the relative humidity an amount of curl induced by the fuser assembly in substrates; determining a maximum amount of acceptable longitudinal curl in substrates; determining a required amount of substrate curl reduction by taking a difference of the induced curl and the acceptable curl; determining a base temperature for the backup member; determining a change in backup member temperature from the base temperature to reduce substrate curl by using a relationship between a change in backup member temperature and a corresponding change in substrate curl and the required amount of substrate curl reduction; and determining the minimum backup member temperature by adding the change in backup member temperature to the base temperature.

The step of determining from the relative humidity an amount of curl induced by the fuser assembly in substrates may comprise the step of estimating the amount of curl induced by the fuser assembly in substrates using a predetermined relationship between induced curl and relative humidity.

The step of determining a change in backup member temperature from the base temperature to reduce substrate curl by using a relationship between a change in backup member temperature and a corresponding change in substrate curl and the required amount of substrate curl reduction may comprise the step of multiplying the required amount of substrate curl reduction by a predetermined factor comprising a change in the backup member temperature over a corresponding change in substrate curl caused by the change in the backup member temperature.

In accordance with a second aspect of the present invention, a method is provided for reducing substrate curl as one or more substrates are conveyed through a fuser assembly having a heating member and a pressure member cooperating with the heating member to fuse images onto the one or more substrates. The method may comprise the steps of: determining a fuser assembly temperature; determining a voltage applied to a toner image transfer roller if the fuser assembly temperature is less than a predefined value; determining relative humidity based on the determined voltage applied to the toner image transfer roller; determining a required curl reduction based on the determined relative humidity, if the determined relative humidity is greater than a predefined value; determining a minimum backup member temperature based on the required curl reduction; determining a current backup member temperature; conveying one or more substrates through the fuser assembly; and increasing an interpage gap between the conveyed one or more substrates if the current backup member temperature is less than the minimum backup member temperature.

In accordance with a third aspect of the present invention, a fuser assembly within an image forming apparatus having a paper path along which substrates travel through the image forming apparatus is provided. The fuser assembly comprises: a heating member; a backup member cooperating with the heating member to form a nip therebetween for fusing images onto substrates passing through the nip; structure for conveying substrates along the paper path to the nip; and a processor for determining a relative humidity, determining if the relative humidity is above a predefined value corresponding to undesirable substrate curl; setting an interpage gap between conveyed substrates to a nominal value if the relative humidity is below the predefined value; and determining if the interpage gap should be increased beyond the nominal value if the relative humidity is above the predefined value.

The processor may determine a relative humidity by determining a voltage applied to a transfer roller at a toner image transfer station within the image forming apparatus; and estimating the relative humidity using a predetermined relationship between the voltage applied to the transfer roller and relative humidity.

The processor may determine if the interpage gap should be increased beyond the nominal value by determining a minimum backup member temperature corresponding to an acceptable level of substrate curl; and increasing the interpage gap if a current backup member temperature is less than the minimum backup member temperature.

The processor may determine a minimum backup member temperature corresponding to an acceptable level of substrate curl by determining from the relative humidity an amount of curl induced by the fuser assembly in substrates; determining a maximum amount of acceptable longitudinal curl in substrates; determining a required amount of substrate curl reduction by taking a difference of the induced curl and the acceptable curl; determining a base temperature for the backup member; determining a change in backup member temperature from the base temperature to reduce substrate curl by using a relationship between a change in backup member temperature and a corresponding change in substrate curl and the required amount of substrate curl reduction; and determining the minimum backup member temperature by adding the change in backup member temperature to the base temperature.

The processor may determine from the relative humidity an amount of curl induced by the fuser assembly in substrates by estimating the amount of curl induced by the fuser assembly in substrates using a predetermined relationship between induced curl and relative humidity.

The processor may determine a change in backup member temperature from the base temperature to reduce substrate curl by using a relationship between a change in backup member temperature and a corresponding change in substrate curl and the required amount of substrate curl reduction by multiplying the required amount of substrate curl reduction by a predetermined factor comprising a change in the backup member temperature over a corresponding change in substrate curl caused by the change in the backup member temperature.

DETAILED DESCRIPTION

Figure 1:
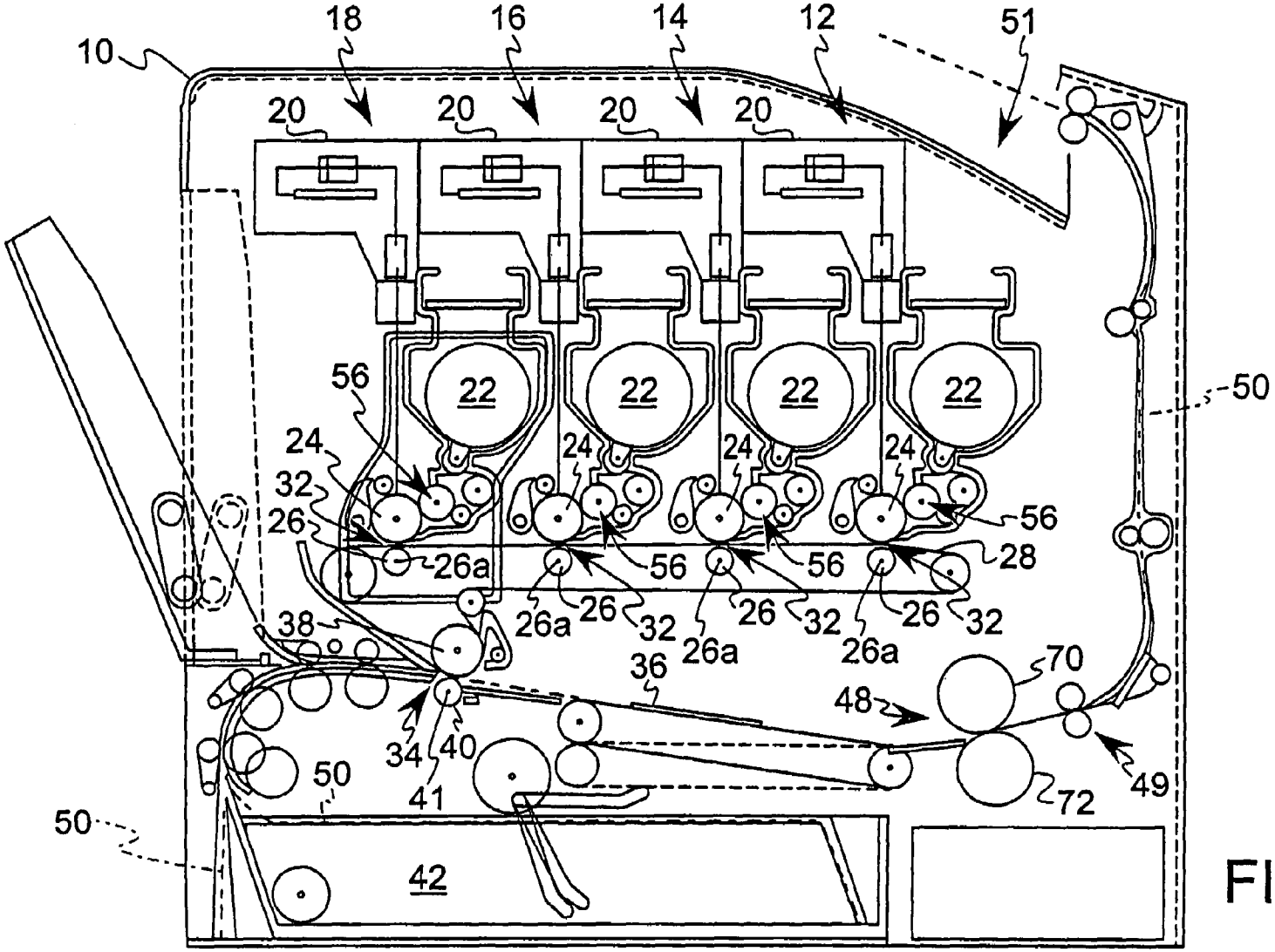
FIG. 1 is a side view of a color electrophotographic (EP) printer with a single-pass intermediate transfer member belt for performing the method of the present invention.

Referring to FIG. 1, a color electrophotographic (EP) printer 10 is illustrated including four image forming stations 12, 14, 16, 18 for creating yellow (Y), cyan (C), magenta (M) and black (K) toner images. Each image forming station 12, 14, 16 and 18 includes a laser printhead 20, a toner supply 22 and a developing assembly 56. Each image forming station 12, 14, 16 and 18 also includes a rotatable photoconductive (PC) drum 24. A uniform charge is provided on each PC drum 24, which is selectively dissipated by a scanning laser beam generated by a corresponding printhead 20, such that a latent image is formed on the PC drum 24. The latent image is then developed during an image development process via a corresponding toner supply 22 and developing assembly 56, in which electrically charged toner particles adhere to the discharged areas on the PC drum 24 to form a toned image thereon. An electrically biased transfer roller 26 opposes each PC drum 24. An intermediate transfer member (ITM) belt 28 travels in an endless loop and passes through a nip defined between each PC drum 24 and a corresponding transfer roller 26. The toner image developed on each PC drum 24 is transferred during a first transfer operation to the ITM belt 28 by an electrically biased roll transfer operation. The four PC drums 24 and corresponding transfer rollers 26 constitute first image transfer stations 32.

At a second image transfer station 34, a composite toner image, i.e., the yellow (Y), cyan (C), magenta (M) and black (K) toner images combined, is transferred from the ITM belt 28 to a substrate 36, see FIG. 1. The second image transfer station 34 includes a backup roller 38, on the inside of the ITM belt 28, and a transfer roller 40, positioned opposite the backup roller 38. The transfer roller 40 includes a transfer roller shaft 41, see FIGS. 1 and 2. Substrates 36, such as paper, cardstock, labels, or transparencies, are fed from a substrate supply 42 to the second image transfer station 34 so as to be in registration with the composite toner image on the ITM belt 28. The composite image is then transferred from the ITM belt 28 to the substrate 36. Thereafter, the toned substrate 36 passes through fuser assembly 48, where the toner image is fused to the substrate 36, as described more fully below. The substrate 36 including the fused toner image continues along a paper path 50 until it exits the printer 10 into an exit tray 51.

The ITM belt 28 may be made from the same material and have the same characteristics as the belt 28 set out in U.S. Pat. No. 6,681,094, the entire disclosure of which is incorporated by reference herein.

The paper path 50 taken by the substrates 36 in the printer 10 is illustrated schematically by a dashed line in FIG. 1. It will be appreciated that other printer configurations having different paper paths may be used. Further, one or more additional media supplies or trays, including manually fed media trays, may be provided.

Each PC drum 24 is typically formed with a metal core, preferably of aluminum. The core is coated with a multilayer organic photoconductive material. The surface potential of each PC drum 24 may range from about −260 V to about −1050 V. Each transfer roller 26*a* is typically formed from a urethane foam with a conductive agent therein, such as an ionic salt. Each drum 24 and transfer roller 26 may have the dimensions and characteristics of the PC drums and transfer rollers set out in U.S. Pat. No. 6,681,094.

To effect the movement of toner material from the PC drums 24 to the ITM belt 28, a high voltage power supply (HVPS) 62 is electrically connected to a shaft 26A of each transfer roller 26 to apply a voltage to the transfer roller 26 opposite in polarity to the charge on the toner. The voltage range of the high voltage power 62 supply is typically −200 V to +3000 V. During printing, the voltage on each transfer roller 26 may range from −200 V to +3000 V.

The backup roller 38 at the second image transfer station 34 may comprise an uncoated metal roller, preferably nickel-plated aluminum, with an applied bias voltage of −200 V. The transfer roller 40 may be formed from a urethane foam with a conductive agent therein, such as an ionic salt. The voltage of the transfer roller 40 may vary from about −200 V to about +4700 V during image transfer. The backup roller 38 and the transfer roller 40 may have the dimensions and characteristics of the backup roller 38 and transfer roller 40 set out in U.S. Pat. No. 6,681,094.

Figure 2:
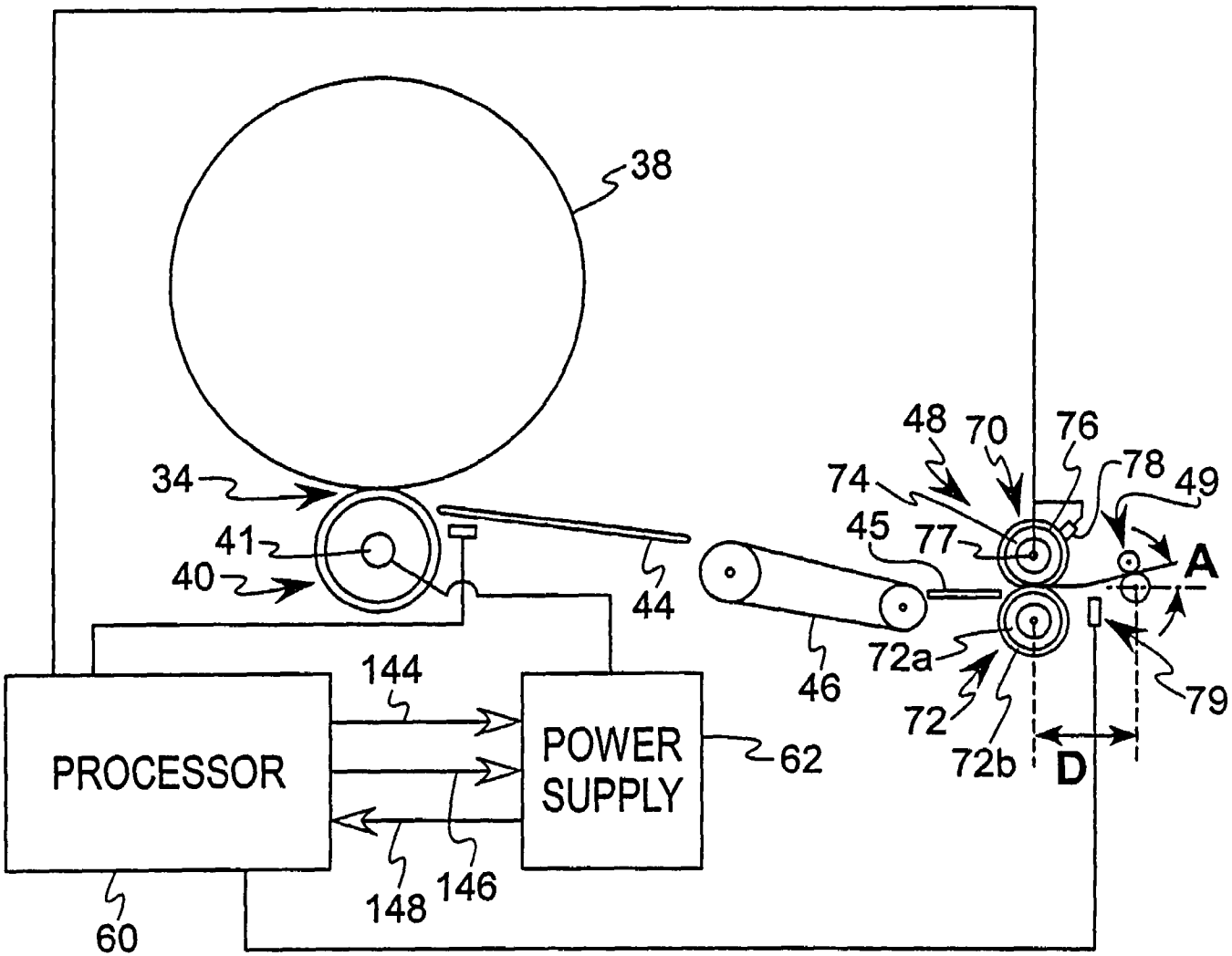
FIG. 2 is a schematic view of part of the EP printer of FIG. 1.

In the illustrated embodiment, the substrate 36 exits a second image transfer station transfer nip defined between the backup roller 38 and the transfer roller 40 onto a media guide plate 44, see FIG. 2. The guide plate 44 has a ribbed configuration. The substrate 36 exits the transfer nip at the second image transfer station 34 at an angle of approximately −10° to −15°, or 10° to 15° below horizontal, to the ribbed media guide plate 44.

The substrate 36 is then guided by the guide plate 44 to a media transport belt assembly 46 comprising one or more parallel belts that carry the substrate 36 to the fuser assembly 48, see FIG. 2. The substrate 36 is attracted to the belt 46 assembly electrostatically via image charge, and in the preferred embodiment, also by vacuum.

The substrate 36 then enters the fuser assembly 48, which has an electrical design capable of handling the toned and partially charged media without disturbing the toned image. A short guide plate 45 bridges the gap between media transport belt and the entrance to the fuser assembly 48.

Referring again to FIG. 2, the fuser assembly 48 in the illustrated embodiment includes a fuser hot roller 70 defining a heating member, and a fuser backup roller 72 defining a backup member cooperating with the hot roller 70 to define a nip for conveying substrates 36 therebetween. The backup roller 72 may press into the hot roller 70 so as to form with the hot roller 70 a reverse nip to provide desirable release characteristics. The hot roller 70 may comprise a hollow aluminum core member 74 covered with a thermally conductive elastomeric material layer 76. A heater element 77, such as a tungsten-filament heater, is located inside the core 74 of the hot roller 70 for providing heat energy to the hot roller 70 under control of a print engine controller (hereinafter "processor") 60. In addition, a temperature sensor 78 is provided for sensing the temperature of the hot roller 70 and for sending a corresponding signal to the processor 60. The backup roller 72 comprises a hollow aluminum core member 72*a* covered with a thermally non-conductive elastomeric material layer 72*b*. In the illustrated embodiment, the backup roller 72 does not include a heater element. Both the hot and backup rollers 70 and 72 may include a PFA (polyperfluoroalkoxy-tetrafluoroethylene) sleeve (not shown) around their elastomeric material layers 76, 72*b*.

As noted above, when a printer includes a fuser assembly having a reverse nip and a backup roller without a heater element, negative longitudinal curl around a longitudinal axis of the substrate may occur. As humidity of the air in which the printer is used increases, the negative longitudinal paper curl may increase to the point where it becomes unacceptable. In accordance with the present invention, humidity is estimated via monitoring a servo voltage supplied to the second image transfer station transfer roller 40. If the humidity increases above a predefined value, then a gap between adjacent substrates 36 may be increased, depending upon a current temperature of the backup roller 72, so as to allow the temperature differential between the hot roller 70 and the backup roller 72 to decrease. When the temperature differential between the hot and backup rollers 70 and 72 decreases, negative longitudinal curl in fused substrates 36 decreases as well.

Figure 3:
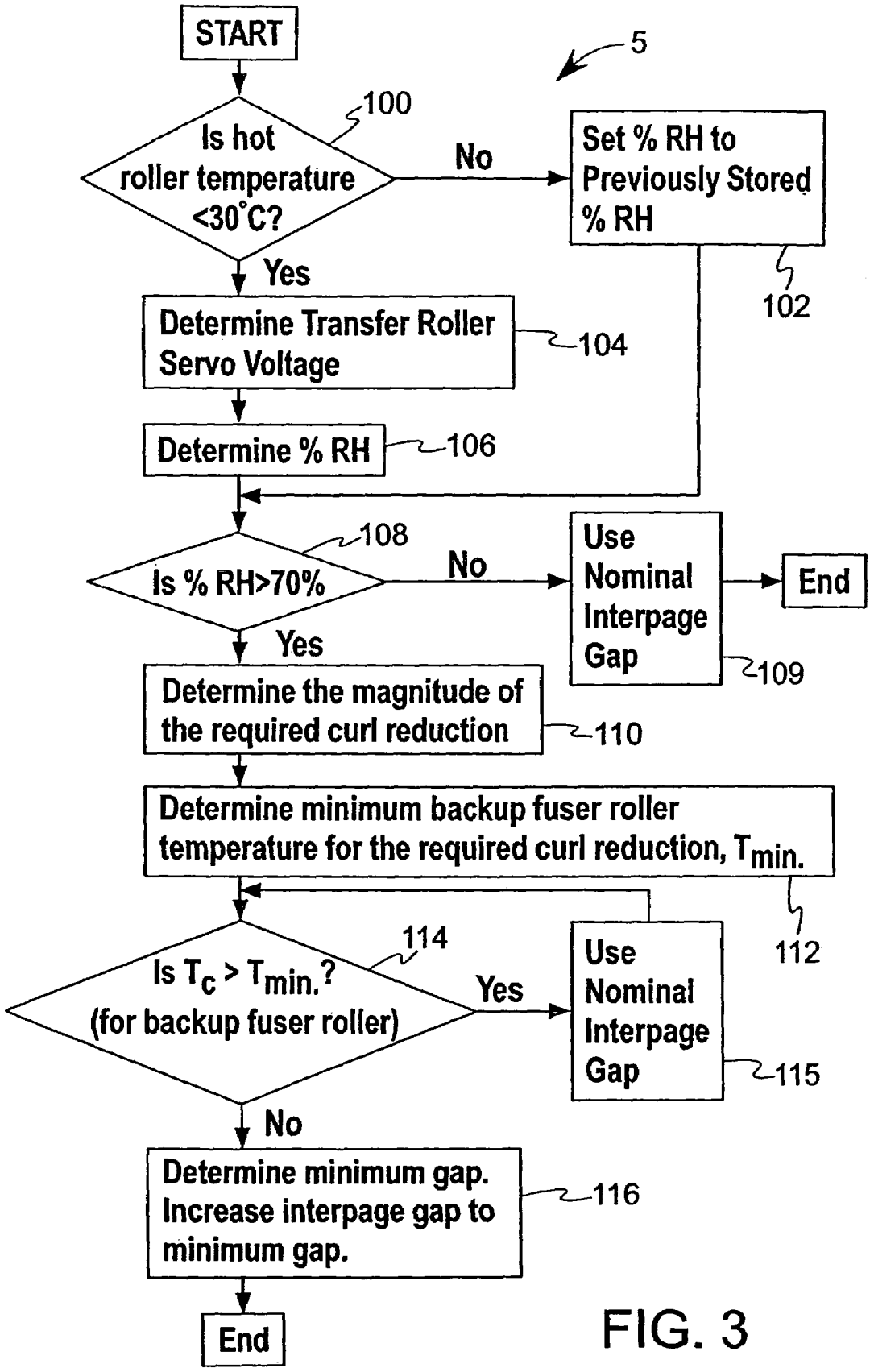
FIG. 3 is a flow diagram showing the method for reducing sheet material curl.

A method 5 in accordance with the present invention for determining if an interpage gap, i.e., a gap between substrates 36 moving along the paper path 50, should be increased in order to reduce negative longitudinal curl will now be discussed with reference to the steps set out in FIG. 3. The processor 60 may implement the steps of method 5 for each print operation, such as at the beginning of a print operation. A print operation may comprise the printing of a single substrate or the continuous printing of two or more substrates of the same type, at the same nominal production rate and at the same hot roller set point temperature. Steps conducted in accordance with this method 5 may be implemented via processor code, hardware, other software means or any combination thereof. First, a general description of the method 5 is provided, followed by sample calculations which may be used during implementation of the method 5.

As noted above, the processor 60 may initiate implementation of the steps of method 5 for each print operation. However, for some substrate types, such as heavy cardstock, vinyl labels and transparencies, which are less likely to curl, the processor 60 may not perform the steps set out in FIG. 3 for print operations involving these media types and instead may always use a nominal interpage gap. In the discussion set out below, it is presumed that the method 5 will be used only for paper substrates such as plain paper substrates, glossy or coated paper substrates and light cardstock.

In step 100, the processor 60 determines if the hot roller 70 is at a temperature below a predetermined value, for example, 30 degrees Celsius. During continuous printing, the second image transfer station transfer roller 40 may dry out and heat up, increasing the servo voltage required to be supplied to it. This increased servo voltage may not accurately reflect the conditions, e.g., humidity, in which the printer 10 is being used. Because the cool down time for the hot roller 70 is long, it is presumed that if the hot roller 70 has cooled below 30 degrees Celsius, then the transfer roller 40 should have reacclimated to the surrounding environmental conditions. The hot roller 70 temperature may be determined by reading the temperature sensor 78, which is in contact with or near the hot roller 70, or by other means.

If the hot roller temperature is equal to or greater than 30 degrees Celsius, then the processor 60 retrieves from memory a previously stored relative humidity value stored in non-volatile memory, see step 102, and proceeds directly to step 108. The manner in which a relative humidity value is determined is discussed below with regards to steps 104 and 106.

If the hot roller temperature is below the predetermined value in step 100, the servo voltage of the second image transfer station transfer roller 40 is determined, see step 104. A method for determining the transfer roller servo voltage is explained in detail below.

Figure 4:
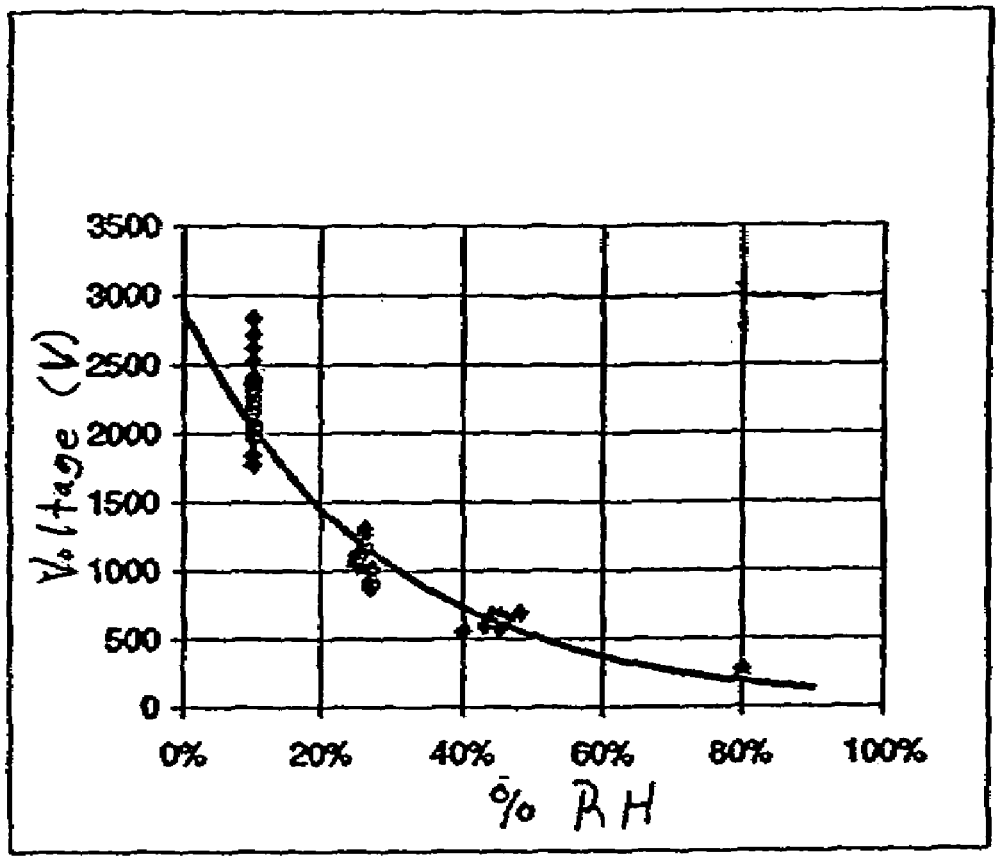
FIG. 4 is a graph illustrating the variation of the voltage applied to a toner image transfer roller with changes in the percentage of relative humidity.

Using the established servo voltage, relative humidity of the environment in which the printer 10 is being used is estimated using an equation determined from experimental data, accessing a look-up table based on experimental data or via another estimation technique, see step 106. Example experimental data showing a relationship between relative humidity and the servo voltage applied to the second image transfer station transfer roller 40 is shown in the graph of FIG. 4.

In step 108, if the relative humidity determined in step 106 or retrieved from non-volatile memory in step 102 is less than or equal to a predefined value, such as, for example, 70%, then the processor 60 effects the printing operation without increasing the interpage gap. Instead, the printing operation occurs using an interpage gap set to a nominal value, step 109, e.g., two inches. This is because it is presumed that negative longitudinal curl will be within an acceptable range at relative humidity values below the predefined value. If, however, the processor 60 estimates that the relative humidity is greater than the predefined value, 70% in the illustrated embodiment, then the processor 60 proceeds to step 110.

Figure 5:
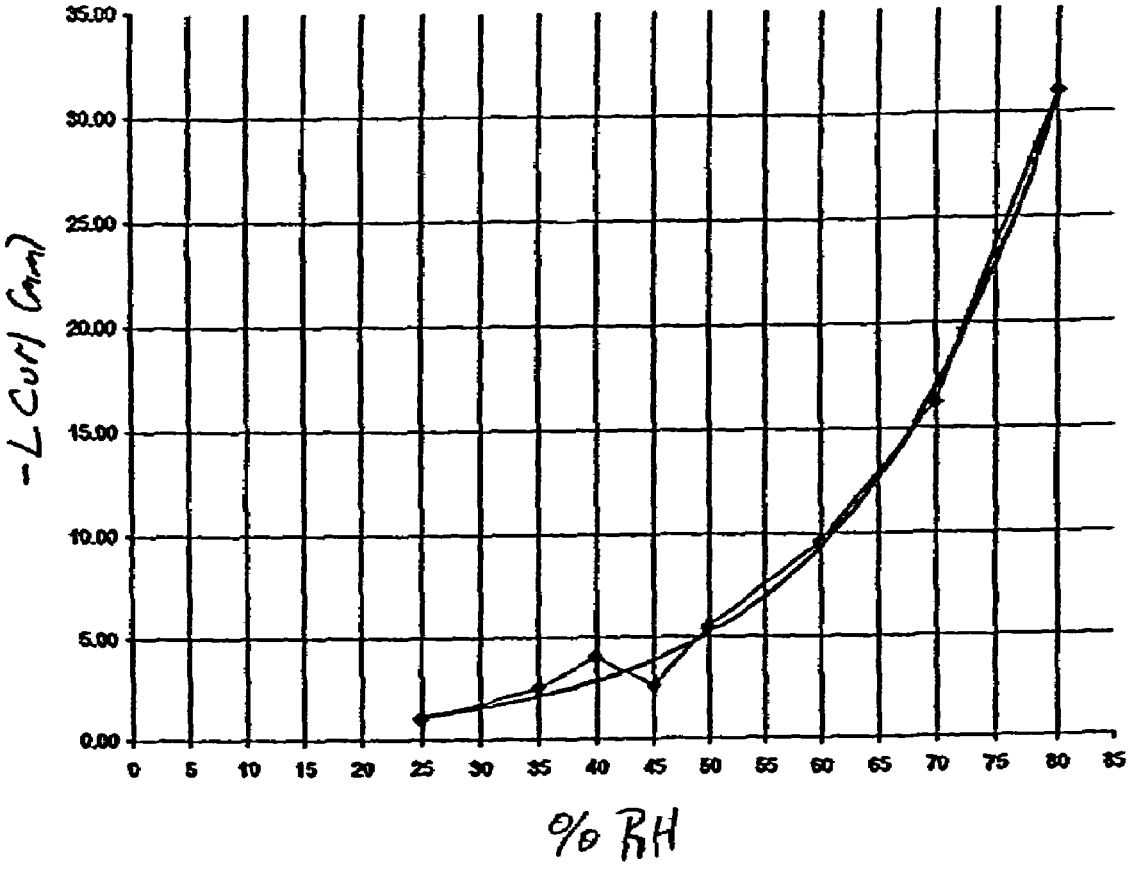
FIG. 5 is a graph illustrating the variation of-L curl with changes in the percentage of relative humidity.

If the printer 10 is operating in a high relative humidity environment, i.e., where the relative humidity is greater than the predefined value, then the processor 60 estimates from the estimated relative humidity value a total amount of negative longitudinal curl induced by the fuser assembly 48 in substrates 36. In estimating induced curl, the processor 60 uses an equation determined from experimental data, accesses a look-up table based on experimental data or uses a like estimation technique. A single look-up table or a single equation may be used for all substrate types. Alternatively, separate experimental data may be collected for two or more substrate types, e.g., plain paper substrates, light cardstock and glossy or coated paper substrates, such that a corresponding look-up table or equation is created for each substrate type and used for that substrate type when estimating induced negative longitudinal curl. Example experimental data showing a relationship between relative humidity and induced negative longitudinal curl for plain paper substrates is shown in the graph of FIG. 5.

A maximum amount of acceptable negative longitudinal curl in substrates 36 passing through the printer 10 is estimated through experimental use of the printer 10. That is, it is determined what maximum amount of curl substrates 36 may have during printing operations so as not to cause an unacceptable rate of jams within the paper path 50 in the printer 10. A single maximum acceptable negative longitudinal curl value may be defined for all substrate types. Alternatively, separate maximum acceptable negative longitudinal curl values may be designated for two or more substrate types, e.g., plain paper substrates, light cardstock and glossy or coated paper substrates, such that a corresponding maximum acceptable negative longitudinal curl value is provided for each substrate type.

In step 110, a required amount of curl reduction is determined by taking the difference between the estimated amount of negative longitudinal curl induced by the fuser assembly 48, which estimated curl value is based on the previously estimated relative humidity, and the maximum amount of acceptable negative longitudinal curl.

From experimental data, a relationship between a change in backup roller temperature and a corresponding change in negative longitudinal curl is determined. A single relationship between a change in backup roller temperature and a corresponding change in negative longitudinal curl may be defined for all substrate types. Alternatively, separate relationships may be defined for two or more substrate types, e.g., plain paper substrates, light cardstock and glossy or coated paper substrates, such that a corresponding relationship is provided for each substrate type. For example, it was determined for plain paper substrates printed by a printer having a construction similar to the printer 10 illustrated in FIGS. 1 and 2 that for every 1 degree Celsius increase in backup roller temperature, there was a corresponding decrease in negative longitudinal curl of 0.45 mm. Using such a relationship and the required amount of curl reduction, a change in backup roller temperature from a base or lower-most backup roller temperature is determined. The base or lower-most backup roller temperature is defined as the steady state temperature of the backup roller 72 during a continuous printing operation, where the interpage gap is set to the nominal value, i.e., where substrates are printed at a nominal or intended production rate, which is discussed below. A single base temperature may be defined for all substrate types. Alternatively, separate base temperatures may be defined for two or more substrate types, e.g., plain paper substrates, light cardstock and glossy or coated paper substrates, such that a corresponding base temperature is provided for each substrate type. The change in backup roller temperature is added to the base temperature and the sum is defined as a minimum backup roller temperature $T_{min}$, see step 112. By raising the base temperature of the backup roller 72 to the minimum backup roller temperature $T_{min}$, a temperature differential between the hot and backup rollers 70 and 72 is reduced such that negative longitudinal curl is lowered.

In step 114, a current backup roller temperature $T_c$ is compared to the determined minimum backup roller temperature $T_{min}$. Since the backup roller 72 does not have a heater element and associated temperature sensor, the current backup roller temperature $T_c$ may be determined by an estimation algorithm discussed in more detail below. If the current backup roller temperature is above the minimum temperature, then the processor 60 presumes that the temperature differential between the hot and backup rollers 70 and 72 is acceptable, i.e., is not too large. Consequently, the processor 60 does not increase the interpage gap, but, instead, maintains the interpage gap at the nominal value, see step 115. The processor 60 then waits a predefined time period, such as 30 seconds to one minute, and returns to step 114 to compare an updated current backup roller temperature $T_c$ to the determined minimum backup roller temperature $T_{min}$.

In step 114, if the processor 60 determines that the current backup roller temperature $T_c$ is less than the minimum backup roller temperature $T_{min}$, then the processor 60 determines an increased interpage gap, see step 116. The processor 60 then updates the interpage gap to the new, increased value, see step 116 again. This increase interpage gap is used for the remainder of the print operation.

Hypothetical example calculations based on the flow diagram of FIG. 3 for the printing of plain paper substrates will now be described. It will be readily understood that such an example is intended to further explain the steps of the flow diagram of FIG. 3 without limiting the scope of the invention in any way.

In this example, it is presumed that the temperature of the hot roller 70 is below 30 degrees Celsius. Hence, the processor 60 proceeds to step 104.

The relative humidity of the environment in which the printer 10 is used can be estimated by the processor 60 using the value of the servo voltage provided to the second image transfer station transfer roller 40 and a look-up table created based on experimental data, such as the data illustrated in FIG. 4. The data illustrated in FIG. 4 is actual data determined using an actual printer having a construction similar to the printer 10 illustrated in FIGS. 1 and 2. Alternatively, an equation determined from the data illustrated in FIG. 4, may be used by the processor 60. This equation is as follows:

$$\%\ RH=(\ln(SV/2885.9))/(-3.404)$$

where % RH=percent relative humidity; and

SV=servo voltage

Using this equation and for a hypothetical servo voltage=202.9 V, the percent relative humidity would be about 78%. Because the relative humidity is greater than 70%, the processor 60 proceeds to step 110.

The processor 60 estimates the amount of negative longitudinal curl induced in substrates 36 passing through the printer 10 based on the estimated relative humidity and a look-up table created based on experimental data, such as the data illustrated in FIG. 5. The data illustrated in FIG. 5 is data determined during the printing of plain paper substrates using an actual printer having a construction similar to the printer 10 illustrated in FIGS. 1 and 2. Alternatively, an equation determined from the data illustrated in FIG. 5, may be used by the processor 60. This equation is as follows:

$$-LC=0.2634e^{(0.0596)(\%\ RH)}$$

where −LC=negative longitudinal curl; and

% RH=percent relative humidity

For a hypothetical relative humidity of 78%, −LC=27.5 mm.

A maximum amount of acceptable negative longitudinal curl for substrates 36 passing through the printer 10 is determined based on experimental use of the printer. That is, it is determined what maximum amount of curl substrates 36 may have during printing operations without causing an unacceptable rate of jams along the paper path 50. A required curl reduction, see step 110, is determined by taking the difference between the estimated amount of negative longitudinal curl induced by the fuser assembly 48 and the maximum amount of acceptable negative longitudinal curl. Presuming that the maximum amount of acceptable negative longitudinal curl is defined as 20 mm for plain paper substrates passing through a printer constructed similar to the printer illustrated in FIGS. 1 and 2, then, in this example, the required curl reduction is equal to 27.5 mm−20 mm or 7.5 mm.

An experimentally determined relationship is determined between a change in the backup roller temperature and a change in the amount of negative longitudinal curl induced by the fuser assembly 48. For plain paper substrates printed using a printer constructed similar to the printer illustrated in FIGS. 1 and 2, it was experimentally determined that for every 1 degree Celsius increase in the backup roller temperature, there was a corresponding decrease in negative longitudinal curl of 0.45 mm.

Next, a minimum backup roller temperature $T_{min}$ is determined per step 112. First, the required curl reduction of 7.5 mm (as determined above) is multiplied by the factor or ratio for plain paper substrates printed using a printer constructed similar to the one illustrated in FIGS. 1 and 2, wherein the factor comprises an increase of one degree Celsius of the backup roller temperature over a 0.45 mm known reduction in curl to yield a compensation value of 16.6° C. This compensation value is then added to a base backup roller temperature which may be equal to a steady state temperature for the backup roller 72 during a continuous printing operation, where substrates 36 are printed at a nominal production rate, which is discussed below. For a printer printing plain paper substrates constructed similar to the one illustrated in FIGS. 1 and 2, this base temperature is 80° C. For such a printer, the minimum backup roller temperature $T_{min}$ is calculated as 16° C.+80° C.=96° C.

Next, the processor 60 determines if the estimated current backup roller temperature $T_c$, determined by the method discussed below, is greater than the minimum backup roller temperature $T_{min}$, calculated above, see step 114. If $T_c>T_{min}$, then the processor 60 uses a nominal interpage gap, see step 115, i.e., the substrates 36 are printed at a nominal production rate, discussed below. The processor 60 then waits a predefined time period, such as 30 seconds to one minute, and returns to step 114 to compare an updated current backup roller temperature $T_c$ to the determined minimum backup roller temperature $T_{min}$. The processor 60 continues implementing steps 114 and 115 in this manner until either an updated value of the current backup roller temperature $T_c$ is less than or equal to the minimum backup roller temperature $T_{min}$ or the print operation has concluded.

If the estimated temperature of the backup roller $T_c$ is not greater than the minimum backup roller temperature $T_{min}$, an increased minimum gap is determined, see step 116. The increased minimum gap is determined based on the minimum backup roller temperature $T_{min}$ determined during step 112. Throughput percentage is defined as the actual number of substrates printed or processed per unit of time divided by a nominal or intended printer production rate, which nominal production rate corresponds to the nominal interpage gap, i.e., the intended rate at which substrates are processed by the printer 10. As discussed below, the steady state temperature of the backup roller 72 varies with changes in the throughput percentage of the substrates 36, presuming that other factors such as set point temperature, media type and nominal production rate are held constant for a given print operation, see FIG. 6. By using the minimum backup roller temperature $T_{min}$ determined during step 112, a corresponding throughput percentage is determined by the processor 60 via a lookup table created based on experimental data, such as the data set out in FIG. 6. For example, presuming that the printer 10 is printing on 20 pound, plain paper letter substrates at a nominal production rate of 24 pages/minute, a steady state backup roller temperature of 96° C., i.e., a minimum backup roller temperature $T_{min}$ determined during step 112, corresponds to a throughput percentage of about 75%, see FIG. 6. From the throughput percentage, a new or updated printer production rate corresponding to the minimum backup roller temperature $T_{min}$ is determined by multiplying the nominal production rate of 24 substrates/minute by 75%. Hence, the new or updated production rate is 24 substrates/minute×0.75=18 substrates/minute.

The total gap (based on plain paper letter size substrate) from one substrate 36 to the next can be determined using the following equation:

Total Gap 32 [(1 page)*(printer paper path speed (inches/second))*(60seconds)]/[(1 minute)*(new production rate)]

Figure 6:
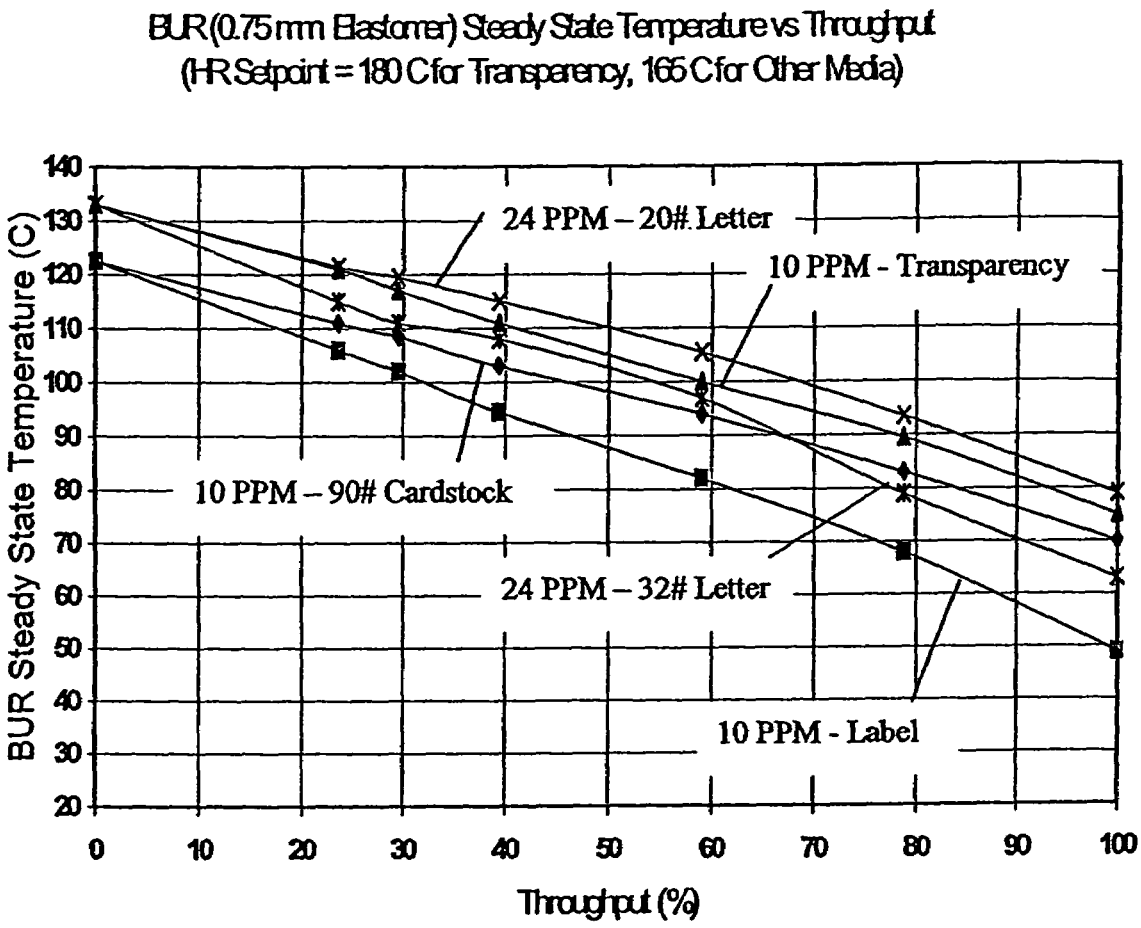
FIG. 6 is a graph illustrating the variation of the backup roller steady state temperature with changes in the rate of processing substrates through the fuser assembly for different print modes of operation for the fuser assembly.

Presuming the printer paper path speed is equal to 5.2 inches/second, i.e., the speed at which the ITM belt moves in the printer 10 as well as the speed at which substrates 36 move along the paper path 50, and the new or updated printer production rate is 18 substrates/minute, determined above using FIG. 6 and the minimum backup roller temperature$_{min}$, then the total gap is equal to:

Total Gap=[(1 page)*(5.2 inches per second)*(60 seconds)]/[(1 minute)*(18 substrates per minute)]=17.3 inches Then, presuming the 20 pound, plain paper letter substrates-have a length of 11 inches, the interpage gap is calculated as 17.3 inches−11 inches=6.3 inches. Hence, the interpage gap is increased to 6.3 inches. This increase in the interpage gap is effected by increasing the time period between when substrates are picked from the tray 42 while the printer paper path speed is held constant. The increased interpage gap is maintained by the processor 60 until the print operation has been completed. By increasing the interpage gap, a greater amount of heat is transferred from the hot roller 70 to the backup roller 72. Consequently, the temperature differential between the two fuser rollers 70, 72 decreases, such that substrate curl is reduced.

As discussed above, the flow diagram of FIG. 3 includes an operation of determining a servo voltage for the second image transfer station transfer roller 40. That operation will now be described.

With reference to FIGS. 1 and 2, a transfer servo operation, such as discussed in U.S. Pat. No. 6,681,094, is performed prior to printing and/or on a periodic basis during printing where the transfer HVPS voltage delivered to the transfer roller 40 is adjusted until a fixed reference current, 8 μA nominal in the illustrated embodiment, is delivered from the HVPS 62 to the transfer roller 40. A similar transfer servo operation with regards to a PC drum and a transfer roller is disclosed in U.S. Pat. No. 5,697,015, the entire disclosure of which is incorporated by reference herein.

The output voltage level of the HVPS 62 is determined by a pulse-width modulated (PWM) logic input 144 from the processor 60, see FIG. 2. The HVPS current limit is selected by a binary logic input 146 from the processor 60. A single binary output 148 of the HVPS 62 is used to indicate to the processor 60 an output voltage of less than 0 volts or an output current greater than 8 μA. The binary output 148 can serve this dual purpose since the output current is not greater than 8 μA when the output voltage is less than 0 volts, except under error conditions. Also, the binary output 148 is used for calibration of the HVPS 62. The voltage on the backup roller 38 is maintained at a controlled potential during this servo operation, nominally −200 V in the illustrated embodiment. The servo voltage to the transfer roller 40 varies with the environment, based on transfer roller resistivity, other environmental factors, and ITM belt resistivity.

First the transfer power supply current limit to the roller 40 is set to 16 μA via the processor binary output 146 and the initial voltage output to the roller 40 is set to −100 volts via processor PWM output 144. The 16 μA current limit enables the HVPS 62 to produce sufficient current to reach an 8 μA reference current comparison point; the −100 volt PWM is sufficiently low that, within manufacturing variation, all power supplies produce a voltage less than zero volts in response to this PWM. Next the HVPS 62 is calibrated by determining the actual PWM value corresponding to a zero volt output. On an initial pass, the HVPS 62 output is normally less than zero volts resulting in a finding that a zero detect is not active. This signal is conveyed to the processor 60 via binary input line 148 from the HVPS 62. Since the zero detect is not active, the PWM is increased corresponding to an increase in the power supply voltage to the roller 40 of +25 volts. The check for zero detect and the increase in power supply voltage are repeated until a signal is obtained indicating that the power supply output is greater than or equal to zero.

Then the first PWM value that produced a power supply output voltage greater than or equal to zero is recorded as a reference point relating processor PWM to power supply output voltage with an accuracy of 25 volts.

Next the servo voltage for the transfer roller 40 is established as follows. The HVPS 62 output is increased by a PWM increment corresponding to +100 V. The binary output line 148 from the HVPS 62 to the processor 60 is then tested to see if the output current is greater than or equal to 8 μA. If not, the HVPS 62 output is increased again by +100 volts and the test is repeated. If yes, the PWM is decreased corresponding to subtracting 200 volts from the HVPS 62 output.

Then the servo process is repeated using finer increments of +25 volts to determine the PWM and corresponding voltage output which produce a current flow greater than or equal to 8 μA. The binary output line 148 from the HVPS 62 to the processor 60 is tested to see if the output current is greater than or equal to 8 μA. If not, the PWM is incremented and the power supply output is increased by +25 volts. The test is then repeated. If yes, then the transfer servo PWM minus the reference point value noted above is recorded as the power supply transfer servo voltage corresponding to an output current of about 8 μA and the servo process is concluded. The servo voltage to the roller 40, equal to the PWM value minus the reference point value, comprises the servo voltage provided to the second image transfer station transfer roller 40, which is used in the estimation of humidity, see steps 104 and 106.

No sheet material 36 is present between the transfer roller 40 and the backup transfer roller 38 during the transfer servo process. Low servo voltages are indicative of low transfer roller resistance and are characteristic of high humidity. High servo voltages are indicative of high transfer roller resistance and are characteristic of a dry environment. Through experimentation, the relationship between transfer roller servo voltages and humidity can be determined, as is apparent from the curve in FIG. 4.

A method for estimating backup roller temperature will now be described. A similar method is set out in U.S. Pat. No. 6,823,150, the entire disclosure of which is incorporated by reference herein. When instructions for a new print operation are received by the printer 10, a substrate type, an appropriate hot roller set point temperature, i.e., a desired temperature for the hot roller 70 during fusing of the corresponding substrate type, and a nominal printer production rate, i.e., the rate at which substrates of the corresponding type are intended to be printed or processed, are determined by the processor 60 from print instruction data input into the printer 10. The processor 60 utilizes the output signal from the temperature sensor 78 to maintain the hot roller 70 at the desired set point temperature during printing.

An exit sensor 79 is provided downstream from the hot and backup rollers 70 and 72, see FIG. 2, for sensing the passage of successive substrates 36 passing through the fuser assembly 48. The sensor 79 generates to the processor 60 signals corresponding to successive "breaks" of the sensor 79 (i.e., resulting from substrates 36 triggering the sensor 79) and "makes" of the sensor 79 (i.e., resulting from gaps between substrates 36). The signals from the exit sensor 79 are used by the processor 60 to determine the actual number of substrates per unit of time processed through the fuser 48. The processor 60 uses the actual number of substrates processed to determine a throughput value, also referred to herein as a throughput percentage, for the print operation. Specifically, the throughput value is a percentage of the nominal production rate specified by the processor 60 for the particular print operation, and is calculated by dividing the actual number of pages printed or processed per unit of time by the nominal production rate. For example, if the specified nominal production rate is 24 pages/minute (ppm) and there are 12 breaks/makes, corresponding to 12 pages detected by the exit sensor 79 during a 1 minute period, the throughput is 50%.

It should be understood that the actual rate of substrates 36 processed, picked or printed, as sensed by the exit sensor 79, may also be expressed in terms of an average gap between successive substrates 36 (an average interpage gap), since, for a constant paper path speed, the size of the interpage gap is directly related to the number of substrates 36 passing through the fuser 48. It should further be noted that information for determining the throughput may also be derived from other process measurements within the printer 10. For example, a substrate pick signal may be used to provide the necessary information for calculating the throughput.

Referring to FIG. 6, the correlation between the throughput and the change in backup roller temperature over time is substantially linear for a given media type. This relationship is used as a basis for estimating the temperature of the backup roller 72. The steady state temperature of the backup roller 72 is a function of the set point temperature of the hot fuser roller 70, the nominal production rate, the substrate type and the actual substrates processed in relation to the nominal production rate, i.e., the throughput. The throughput may vary from print operation to print operation, as well as within a print operation, depending on such variables as print operation size, tray sourcing, the ability of the processor 60 to process input print data, as well as other variables.

The steady state temperature of the backup roller 72 will vary with changes in the throughput of the substrates 36, presuming that other factors such as set point temperature, media type and nominal production rate are held constant for a given print operation as shown in FIG. 6. Accordingly, after the processor 60 calculates the throughput from an input signal, e.g., the signal from the exit sensor 79, these relationships may be used to predict the backup roller steady state temperature in view of the known set point temperature, nominal production rate, and substrate type.

The predicted backup roller steady state temperature is used in a calculation for estimating the transient temperature of the backup roller 72. Specifically, it is possible to estimate the transient temperature of the backup roller 72 based on a known or estimated starting temperature (a "present" temperature) and a predicted steady state temperature, and further assuming that the backup roller 72 will reach the steady state temperature within a time period equal to or less than a maximum time period. The maximum time period is dependent upon the particular characteristics of the fuser assembly 48 including the thermal characteristics affecting the temperature response of the hot roller 70 and the backup roller 72. For the fuser assembly 48, the maximum time for attaining steady state temperature may be assumed to be five minutes. However, this steady state temperature maximum time period may vary for differing fuser assemblies, and can be determined experimentally.

For the following description, it should be noted that when the fuser assembly 48 is initially warming up (i.e., after being initially turned on), or warming up from a power saver mode temperature to a standby temperature or to a print or set point temperature, and no substrates 36 are being processed through the fuser assembly 48, but the hot roller 70 and the backup roller 72 are rotating for at least part of the warmup time, the transient temperature of the backup roller 72 at any given time is estimated based on a known heating rate of the backup roller 72 in relation to a temperature increase of the hot fuser roller 70, which known heating rate can be experimentally determined. Specifically, the temperature of the hot roller 70 is known, for a printer constructed similar to the printer illustrated in FIGS. 1 and 2, to increase at a rate of $1^N$ C./second, and the temperature of the backup roller 72 increases at a rate of $0.7^N$ C./second. Similarly, when the temperature of the fuser assembly 48 is decreasing without processing substrates 36, i.e., with the heater element 77 off, and the hot roller 70 and the backup roller 72 are not rotating, the transient temperature of the backup roller 72 is estimated based on a known cooling rate of the backup roller 72. Specifically, the temperature of both the hot roller 70 and the backup roller 72 for a printer constructed similar to the printer illustrated in FIGS. 1 and 2 decreases at a rate of $6^N$ C./second. Accordingly, for the following description of the backup roller transient temperature, a present temperature, $T_K$, of the backup roller 72, during the times when no substrates 36 are processed, may be estimated based on the heating or cooling rates of the backup roller 72 as it is heating or cooling for a known time from a known temperature (i.e, heating from room temperature in the power saver mode or after being initially turned on). Alternatively, if the printer 10 has been in the same print mode, i.e., a continuous printing operation involving the same substrate type, same nominal production rate and same hot roller set point temperature for a period of time sufficient for attaining a steady state temperature, the initial present backup roller temperature, $T_K$, is set to the attained steady state temperature.

The estimation process begins by setting an initial value of the present backup roller temperature, $T_K$, determined as described above when no substrates 36 are passing through the fuser assembly 48. Then, an actual substrate production rate is determined, i.e., a determine substrate rate step is effected, by measuring the substrate count for a one minute interval, based on the signal received by the processor 60 from the exit sensor 79.

Next, the throughput is determined based on the determined substrate rate relative to the nominal production rate for the print operation, i.e., if 12 media pages pass through the fuser in 1 minute for a nominal production rate of 24 pages per minute (ppm), the throughput is 50%. The throughput is then used to find the corresponding steady state temperature, $T_{SS}$, using, for example, experimental data, such as the data set out in FIG. 6. It should be noted that in order to reduce processing time, the steady state temperature, $T_{SS}$, may be looked up from a table which correlates discrete throughput values to corresponding steady state temperatures, $T_{SS}$. In this case, the calculated throughput values would be rounded up or down to the nearest tabulated value for the throughput values found in the table. Alternatively, an equation providing steady state temperature values as a function of the throughput value for each of the media may be used to calculate the steady state temperatures, $T_{SS}$.

The steady state temperature, $T_{SS}$, is then used in the following equation:

$$)T = \frac{\mathrm{ABS}[T_{SS} - T_K]}{5}$$

to determine the incremental change in temperature, ΔT, for a one minute time interval. Specifically, the change in temperature, ΔT, is calculated as the absolute value of the difference between the steady state temperature, $T_{SS}$, and the present backup roller temperature, $T_K$, divided by five. Since the temperature difference is based on a projection of reaching the steady state temperature, $T_{SS}$, within five minutes and the temperature change with time is assumed to be substantially linear, the temperature difference is divided by five in order to compute the temperature change associated with a one minute increment.

A new present backup roller temperature, $T_N$, is calculated using the change in temperature ΔT. If the present backup roller temperature, $T_K$, is greater than the steady state temperature, $T_{SS}$, then the new backup roller temperature, $T_N$, is set equal to the present backup roller temperature, $T_K$, minus the change in temperature, ΔT; if the present backup roller temperature, $T_K$, is less than the steady state temperature, $T_{SS}$, then the new backup roller temperature, $T_N$, is set equal to the present backup roller temperature, $T_K$, plus the change in temperature, ΔT; and if the present backup roller temperature, $T_K$, is equal to the steady state temperature, $T_{SS}$ then the new backup roller temperature, $T_N$, is set equal to the steady state temperature, $T_{SS}$. Further, if the printer has remained in the same mode for five minutes or more, then the present backup roller temperature, $T_K$, is set equal to the steady state temperature, $T_{SS}$, since the backup roller 72 may be assumed to reach the steady state temperature, $T_{SS}$ within a five minute period.

If the printer 10 has not remained in the same print mode for five minutes, at the next one minute increment, the process sets $T_K$=$T_N$ and returns to the "determine substrate rate" step to proceed through the steps of calculating a new change in temperature, ΔT, for the next one minute interval, based on the current measured substrate rate as determined by the current substrate count measurement. It should be noted that if the printer 10 goes from one mode to a subsequent mode prior to the five minute interval required for the backup fuser roller 72 to reach the steady state temperature or for the estimated transient backup fuser roller temperature to be set to the steady state temperature, $T_{SS}$, the starting present temperature $T_K$ for the subsequent mode will be the last new backup fuser roller temperature, $T_N$, calculated for the preceding mode. Additionally, it should be understood that by setting the present temperature, $T_K$, to be equal to the steady state temperature, $T_{SS}$, after operating for five minutes in the same mode, propagation of cumulative errors in the temperature estimation will be minimized since the steady state temperatures may be assumed to be accurate estimations of the backup roller temperature after remaining in a particular mode for five minutes or more.

The estimated current backup roller temperature $T_c$, used in step 114 above, is equal to $T_{SS}$ if the fuser assembly has been operating in the same print mode for five or more minutes; an initial value of the present backup roller temperature, $T_K$, determined as described above when no substrates 36 are passing through the fuser assembly 48; or the last new backup fuser roller temperature, $T_N$.

In another aspect of the present invention, when the relative humidity is determined to be above a predefined value, for example 70%, the hot roller set point temperature may be reduced, such as by 5° C., to minimize the occurrence of hot toner offset (toner sticking to fuser rollers) and/or fuser wraps. The set point temperature may be reduced for all substrate types or only for paper media such as light cardstock, plain paper substrates and glossy or coated paper substrates. If the hot roller set point temperature is reduced, the processor 60 takes the set point temperature reduction into consideration in effecting the steps set out in the method 5 of FIG. 3. That is, the minimum backup roller temperature $T_{min}$ is reduced by an amount equal to the reduction in the hot roller set point temperature such that the differential between the two temperatures is maintained at a desired value to reduce curl.

Although the above description discusses a color printer, the invention may be used with mono (black only) printers or copiers within the scope of the present invention. Although the above description provides a method of determining the servo voltage or voltage applied to a toner image transfer roller, one skilled in the art will recognize other methods could be used in accordance with the present invention to determine the servo voltage. Although a relationship between the servo voltage was used to estimate the relative humidity, one skilled in the art will recognize that a device for measuring relative humidity directly can be used in accordance with the present invention.

One skilled in the art will recognize that the above described method of reducing fuser induced curl may be combined with other means of reducing curl to provide additional curl reduction as desired. As an example, mechanical changes such as increasing a rebend angle at fuser assembly exit rollers 49, changing the shape of a nip at the exit rollers 49 to impart a positive horizontal curl into substrates 36 and/or moving the exit rollers 49 closer to the hot and backup rollers 70 and 72, as a substrate 36 has a greater tendency to take a set when warm, may be used to further reduce the amount of curl. Increasing the rebend angle at the exit rollers 49 would be achieved by increasing the angle A relative to a horizontal plane passing through the fuser assembly nip, see FIG. 2. This angle A may range from substantially zero degrees to about 8 degrees. Moving the exit rollers 49 closer to the hot and backup rollers 70 and 72 would result in a decreased distance D between the exit rollers 49 and the hot and backup rollers 70 and 72. Although not shown in the drawings, the shape of the nip of the exit rollers 49 may be modified to form a "U-shaped" or forward nip which is known to induce a positive curl, which is opposite in direction to the induced negative curl. This causes the induced curls to counteract each other resulting in reduced overall curl.

Although the above description uses a single lamp fusing system, one skilled in the art will recognize the applicability to other fusing systems such as induction heating, ceramic heating and other such systems.

What we claim is:

1. A method of fusing toner images onto substrates conveyed through a fuser assembly having a heating member and a backup member cooperating with the heating member, the method comprising:

determining a relative humidity;

determining if the relative humidity is above a predefined value corresponding to undesirable substrate curl;

conveying substrates through the fuser assembly at a nominal interpage gap if the relative humidity is below said predefined value; and determining if the interpage gap should be increased beyond the nominal value if the relative humidity is above said predefined value, wherein said determining if the interpage gap should be increased beyond the nominal value comprises: determining a minimum backup member temperature corresponding to an acceptable level of substrate curl, and increasing the interpage gap if a current backup member temperature is less than the minimum backup member temperature.

2. A method as set out in claim 1, wherein determining a relative humidity comprises:

determining a voltage applied to a transfer roller at a toner image transfer station; and estimating the relative humidity using a predetermined relationship between the voltage applied to the transfer roller and relative humidity.

3. A method as set out in claim 1, wherein determining a minimum backup member temperature corresponding to an acceptable level of substrate curl comprises:

determining from the relative humidity an amount of curl induced by the fuser assembly in substrates;

determining a maximum amount of acceptable longitudinal curl in substrates;

determining a required amount of substrate curl reduction by taking a difference of the induced curl and the acceptable curl;

determining a base temperature for the backup member;

determining a change in backup member temperature from the base temperature to reduce substrate curl by using a relationship between a change in backup member temperature and a corresponding change in substrate curl and the required amount of substrate curl reduction; and determining the minimum backup member temperature by adding the change in backup member temperature to the base temperature.

4. A method as set out in claim 3, wherein determining from the relative humidity an amount of curl induced by the fuser assembly in substrates comprises estimating the amount of curl induced by the fuser assembly in substrates using a predetermined relationship between induced curl and relative humidity.

5. A method of reducing sheet material curl as set out in claim 3, wherein determining a change in backup member temperature from the base temperature to reduce substrate curl by using a relationship between a change in backup member temperature and a corresponding change in substrate curl and the required amount of substrate curl reduction comprises multiplying the required amount of substrate curl reduction by a predetermined factor comprising a change in the backup member temperature over a corresponding change in substrate curl caused by the change in the backup member temperature.

6. A method of reducing substrate curl as one or more substrates are conveyed through a fuser assembly having a heating member and a pressure member cooperating with the heating member to fuse images onto the one or more substrates, the method comprising:

determining a fuser assembly temperature;

determining a voltage applied to a toner image transfer roller if the fuser assembly temperature is less than a predefined value;

determining relative humidity based on the determined voltage applied to the toner image transfer roller;

determining a required curl reduction based on the determined relative humidity, if the determined relative humidity is greater than a predefined value;

determining a minimum backup member temperature based on the required curl reduction;

determining a current backup member temperature;

conveying one or more substrates through the fuser assembly; and increasing an interpage gap between the conveyed one or more substrates if the current backup member temperature is less than the minimum backup member temperature.

7. A fuser assembly within an image forming apparatus having a paper path along which substrates travel through the image forming apparatus comprising:

a heating member;

a backup member cooperating with the heating member to form a nip therebetween for fusing images onto substrates passing through said nip;

structure for conveying substrates along the paper path to said nip; and a processor for determining a relative humidity, determining if the relative humidity is above a predefined value corresponding to undesirable substrate curl; setting an interpage gap between conveyed substrates to a nominal value if the relative humidity is below said predefined value; and determining if the interpage gap should be increased beyond the nominal value if the relative humidity is above said predefined value, wherein:

said processor determines if the interpage gap should be increased beyond the nominal value by determining a minimum backup member temperature corresponding to an acceptable level of substrate curl, and increasing the interpage gap if a current backup member temperature is less than the minimum backup member temperature.

8. A fuser assembly as set out in claim 7, wherein said processor determines a relative humidity by determining a voltage applied to a transfer roller at a toner image transfer station within the image forming apparatus; and estimates the relative humidity using a predetermined relationship between the voltage applied to the transfer roller and relative humidity.

9. A fuser assembly as set out in claim 7, wherein said processor determines a minimum backup member temperature corresponding to an acceptable level of substrate curl by determining from the relative humidity an amount of curl induced by the fuser assembly in substrates; determining a maximum amount of acceptable longitudinal curl in substrates; determining a required amount of substrate curl reduction by taking a difference of the induced curl and the acceptable curl; determining a base temperature for the backup member; determining a change in backup member temperature from the base temperature to reduce substrate curl by using a relationship between a change in backup member temperature and a corresponding change in substrate curl and the required amount of substrate curl reduction; and determining the minimum backup member temperature by adding the change in backup member temperature to the base temperature.

10. A fuser assembly as set out in claim 9, wherein said processor determines from the relative humidity an amount of curl induced by the fuser assembly in substrates by estimating the amount of curl induced by the fuser assembly in substrates using a predetermined relationship between induced curl and relative humidity.

11. A fuser assembly as set out in claim 9, wherein said processor determines a change in backup member temperature from the base temperature to reduce substrate curl by using a relationship between a change in backup member temperature and a corresponding change in substrate curl and the required amount of substrate curl reduction by multiplying the required amount of substrate curl reduction by a predetermined factor comprising a change in the backup member temperature over a corresponding change in substrate curl caused by the change in the backup member temperature.

* * * * *